US005176458A

United States Patent [19]

Wirth

[11] Patent Number: 5,176,458

[45] Date of Patent: Jan. 5, 1993

[54] MULTIPLE POSITION THERMAL PRINTER HEAD MECHANISM WHICH IS DISTURBANCE INSENSITIVE

[75] Inventor: Henry G. Wirth, Rochester, N.Y.

[73] Assignee: Eastman Kodak Company, Rochester, N.Y.

[21] Appl. No.: 894,892

[22] Filed: Jun. 8, 1992

[51] Int. Cl.[5] ..... B41J 11/20

[52] U.S. Cl. ..... 400/120; 400/56; 346/36 PH

[58] Field of Search ..... 400/120, 55, 56; 346/76 PH

[56] References Cited

U.S. PATENT DOCUMENTS

| | | | |
|---|---|---|---|
| 4,750,880 | 6/1988 | Stephenson | 400/120 |
| 4,838,713 | 6/1989 | Kanimitsu et al. | 400/120 |
| 4,962,392 | 10/1990 | Okuno et al. | 346/76 PH |
| 5,064,300 | 11/1991 | Kashiwaba | 400/56 |
| 5,087,135 | 2/1912 | Tew et al. | 400/56 |
| 5,087,926 | 2/1992 | Wakui et al. | 346/76 PH |

FOREIGN PATENT DOCUMENTS

| | | | |
|---|---|---|---|
| 3616925 | 4/1987 | Fed. Rep. of Germany | 400/120 |
| 0151282 | 12/1983 | Japan | 400/55 |
| 0266262 | 11/1986 | Japan | 400/120 |
| 0284468 | 12/1986 | Japan | 400/55 |
| 0031669 | 2/1989 | Japan | 400/120 |
| 0015580 | 1/1991 | Japan | 400/120 |

*Primary Examiner*—Eugene H. Eickholt
*Attorney, Agent, or Firm*—Raymond L. Owens

[57] ABSTRACT

Apparatus having a common mounting axis for both a cover mechanism and a head positioning arm isolates a print head from disturbances or distortions caused by a force being applied to the cover mechanism, such as the operator leaning on the cover, which result in inferior print quality.

8 Claims, 6 Drawing Sheets

MULTIPLE POSITION THERMAL PRINTER HEAD MECHANISM WHICH IS DISTURBANCE INSENSITIVE

BACKGROUND OF THE INVENTION

1. Field of the Invention

The present invention relates to a color thermal printing system having a print head assembly which is insensitive to disturbances of the cover mechanism for the thermal printer.

2. Description of the Prior Art

Thermal printers often provide a means to replace the thermal dye donor media and/or the dye receiver media in the printer by opening a portion of the printer. To open the printer, the user releases a latch in a cover mechanism and swings the cover open to gain access to the media supplies. These cover mechanisms are usually located in the top portion of the printer, opening upward.

The cover mechanism can have some of the major printer components attached to it, so that as the cover is swung open these components move away from media transport paths to permit easier loading of new media. The cover mechanism usually has a hinge or pivot axis along one side of the mechanism and a latch component to keep the cover closed during operation but permit opening for loading media. To permit proper latch operation and opening, the cover cannot be rigidly locked to the rest of the thermal printer structure. These configurations have a problem when a weight, such as the user leaning on the cover or a heavy load like a book, is placed upon the cover. These weights distort the cover and move components attached to the cover even though the cover is closed. When the print head is moved, artifacts or defects can be produced in a print.

FIG. 1 shows a prior art thermal printer 10 (see U.S. Pat. No. 4,838,713) where a platen 20 and a receiver supply spool 22 are attached to a cover mechanism 30. The cover mechanism 30 is attached in turn to a main printer structure 12 at cover pivot shaft 32. A print head assembly 70 which mounts a print head 80 and a head positioning mechanism 50 are attached to the main printer structure 12 at a head pivot shaft 52. When the cover mechanism 30 is opened, the platen 20 lifts away from the print head assembly 70. The cover pivot shaft 32 is widely separated from the head pivot shaft 52. When force is applied to the cover mechanism 30, a misalignment of the platen 20 and the print head 80 occurs which is directly related to the separation of the cover and head pivot shafts 32, 52. Such misalignment results in inferior print quality.

Alternate designs for thermal printers reverse the component configurations, attaching the print head assembly to the cover while the platen is attached to the main printer structure. However, these designs also have widely separated pivot shafts for the cover and print head assemblies. All of these thermal printer designs are thus sensitive to disturbance of the cover mechanism caused by, for example, printer vibration. These disturbances result in misalignment of the print head and the platen, producing lower quality prints. The cover mechanism's sensitivity to disturbance is directly related to the distance between the pivot shaft of the cover mechanism and the pivot shaft of the component attached to the cover mechanism, whether the print head assembly or the platen.

SUMMARY OF THE INVENTION

The object of the present invention is to reduce or eliminate the sensitivity of a thermal print head to any distortions or vibrations of a cover mechanism.

A further object of this invention is to provide multiple print head positions during printer operation, permitting optimization of head-to-platen distance and frictional forces for various stages of the printer's operation, such as printing, loading and ejecting.

A further object of this invention is to provide fine position adjustment capability for the head positioning component to reduce component costs.

In the present invention, a print head assembly and a head positioning component are attached to the cover mechanism for the thermal printer. Disturbance of a print head and print head assembly during printer operation due to distortions of the cover mechanism caused by forces or movements are reduced or eliminated by making a pivot axis for the cover mechanism and a pivot axis for the head positioning component substantially coaxial.

These objects are achieved in a thermal printer which has a roller platen, a dye receiver medium held against the roller platen and a print head which presses a dye donor medium against the receiver and roller platen in a sandwich for dye transfer, the improvement comprising:

(a) a cover mechanism rotatably mounted about a first axis, including latching means secured to the cover mechanism for holding the cover mechanism in a closed position during operation and permitting the cover mechanism to be opened at other times;

(b) a head positioning arm rotatably mounted about a second axis such that the head positioning arm is movable between a printing position, and a loading position and an ejecting position;

(c) a print head assembly which includes a print head, the assembly being responsive to the head positioning arm to move the print head to corresponding loading, printing and ejection positions; and (d) the first and second axis being substantially coaxial to thereby reduce undesirable movement of the print head.

Alternatively, if a platen is attached to the cover mechanism of the thermal printer, making the pivot axes of the cover mechanism and a platen assembly coaxial reduces or eliminates such undesirable distortions or movement of the print head.

DESCRIPTION OF THE PREFERRED EMBODIMENTS

Figure 1:
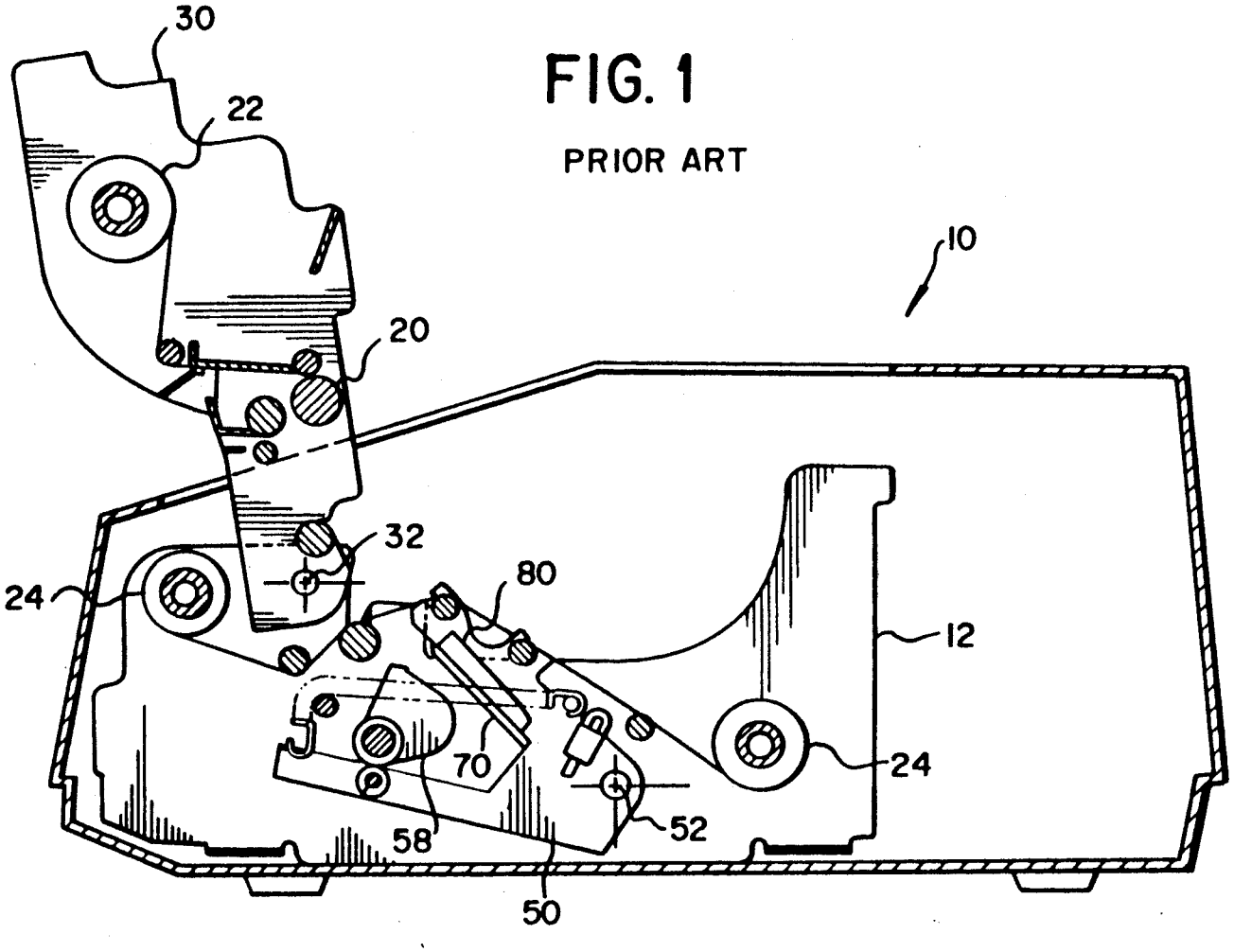
FIG. 1 PRIOR ART
FIG. 1 shows a prior art thermal printer in which a platen is attached to a cover mechanism.

An embodiment of the present invention will be described by referring to FIGS. 2 to 5. Those component elements which are similar to those depicted in FIG. 1 are designated by the same reference numerals.

Figure 2:
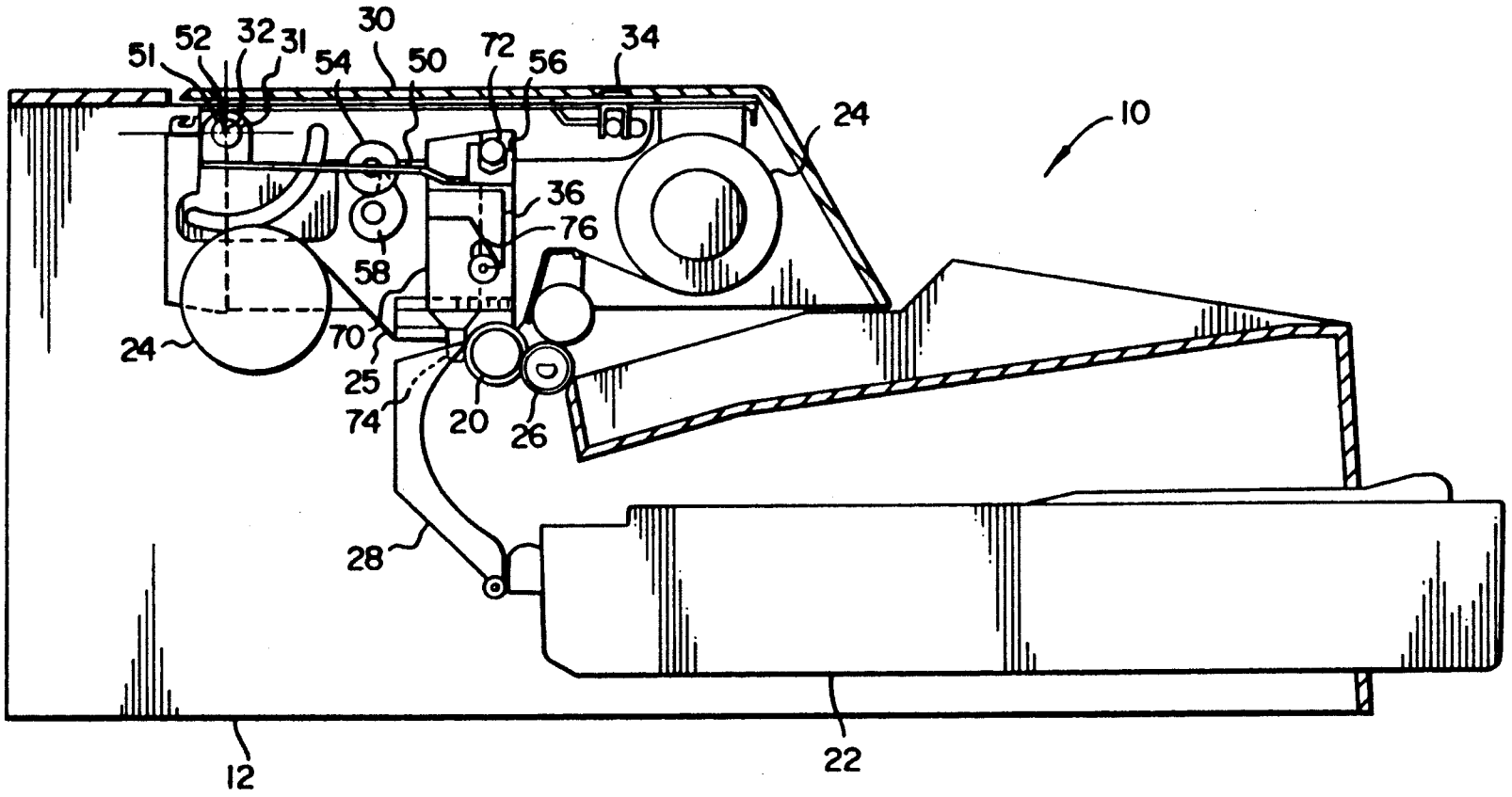
FIG. 2 is a sectional view of a thermal printer according to the present invention.

FIG. 2 shows a thermal printer 10 of the present invention wherein a cover mechanism 30 has several major components attached to it. These components include a head positioning arm 50, a print head assembly 70 and dye donor supply spools 24. A main printer support structure 12 includes a roller platen assembly 20, a receiver medium transport mechanism 26 and a dye receiver medium supply 22. The thermal printer 10 is shown as it operates, with the cover mechanism 30 in a closed position.

The cover mechanism 30 is mounted to the main printer support structure 12 through a cover mechanism mounting axis 32 which is coaxial with a cover mechanism mounting shaft 31. When a latch 34 is released, the cover mechanism 30 can rotate to an open position. The head positioning arm 50 is mounted to the cover mechanism 30 through a head positioning arm mounting axis 52 which is coaxial with a head positioning arm mounting shaft 51. The cover mechanism mounting axis 32 and the head positioning arm mounting axis 52 are located substantially coaxially to reduce or eliminate the transmission of any disturbance or vibration in the cover mechanism 30 to the head positioning arm 50. These two mounting axes 32, 52 may be established by independent mechanical structures or they may be connected in some manner. The basic requirement is that they be substantially coaxial. By coaxial it is meant that the mounting axes 32, 52 are sufficiently close enough that the print head is not disturbed (cause noticeable defects in a print) when disturbances occur.

Figure 3:
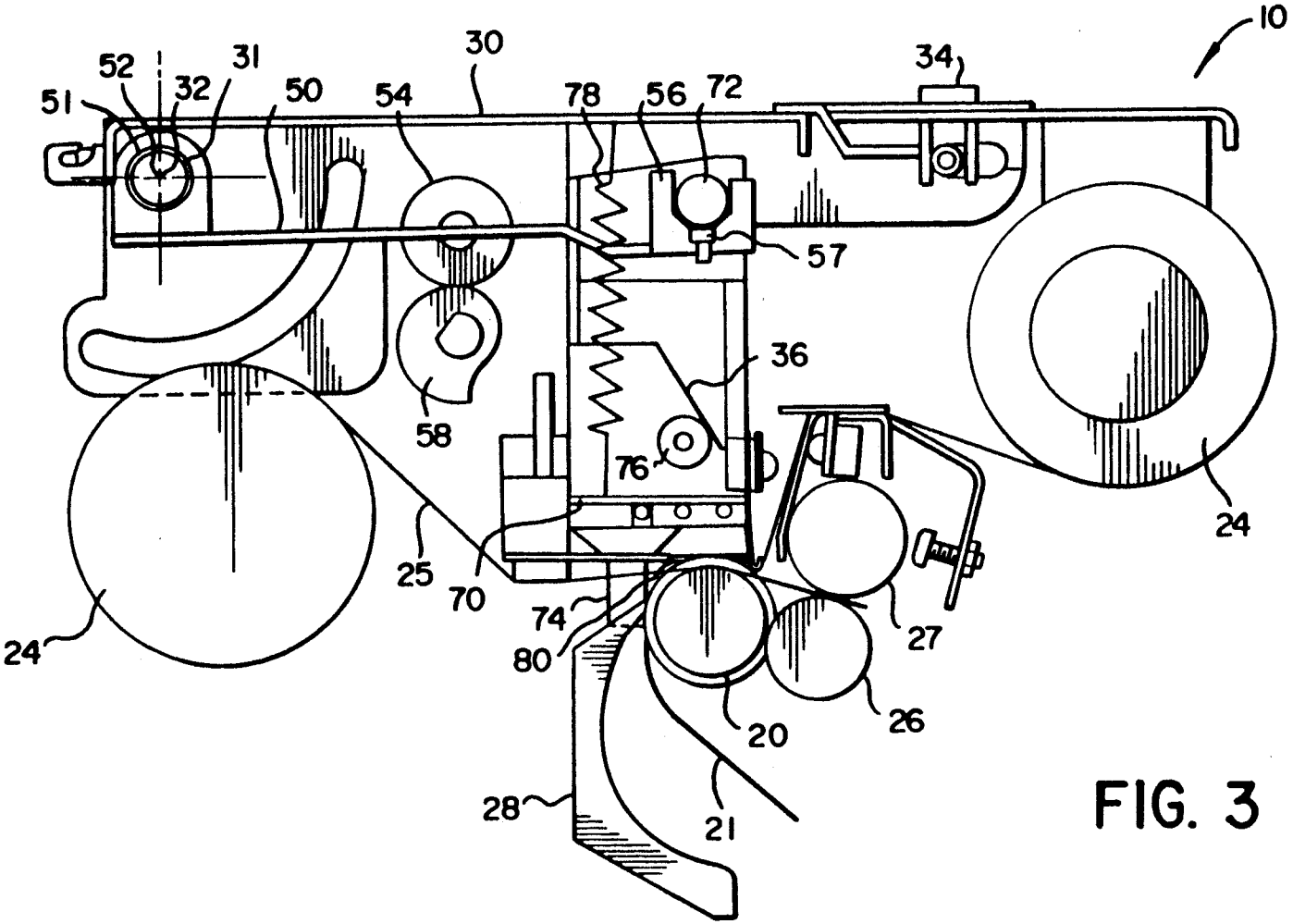
FIG. 3 shows a sectional view of FIG. 2's print head assembly, head positioning mechanism and cover mechanism in a loading position.
Figure 4:
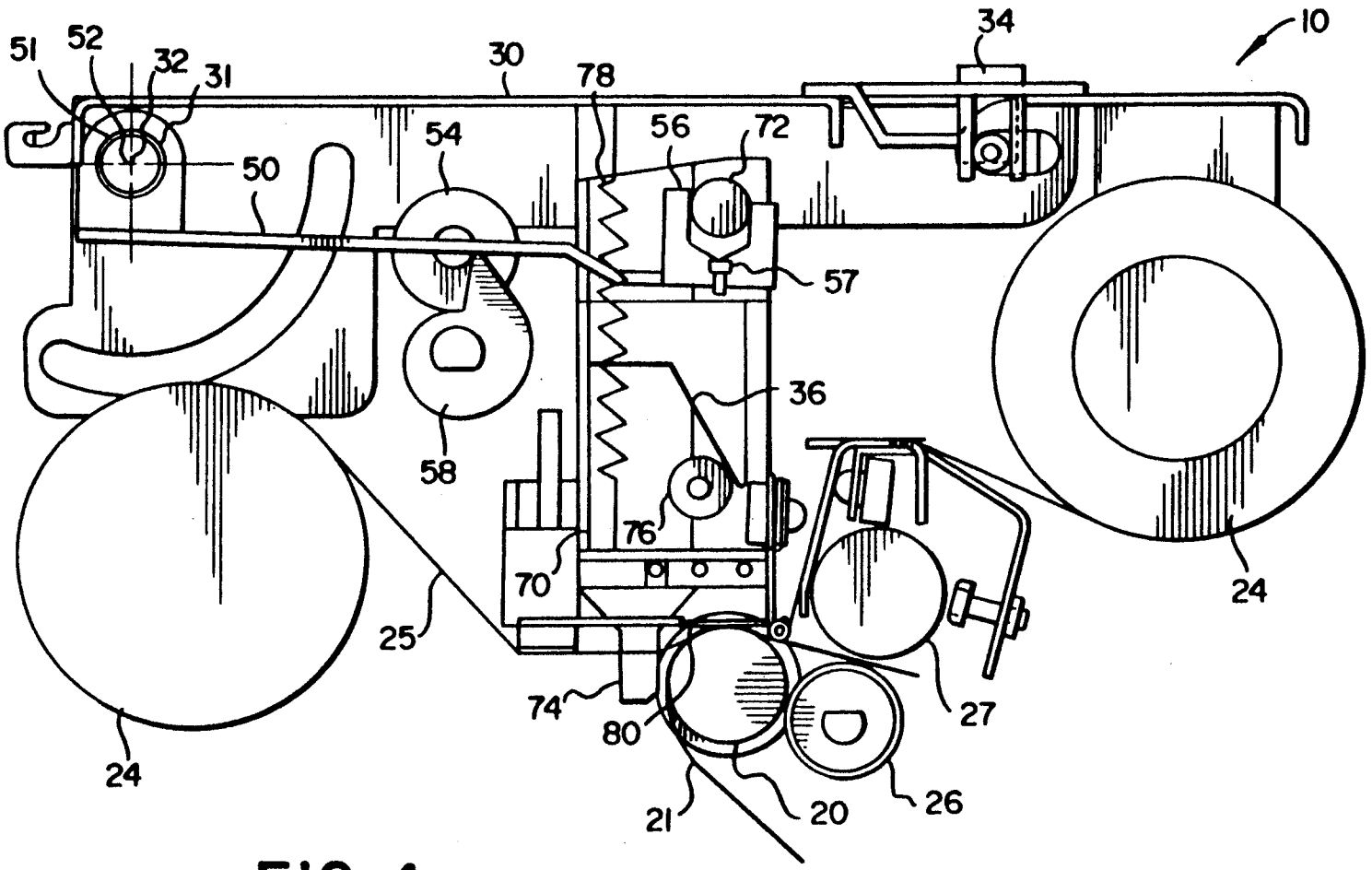
FIG. 4 is a sectional view of FIG. 2's print head assembly, head positioning mechanism and cover mechanism in a printing position.
Figure 5:
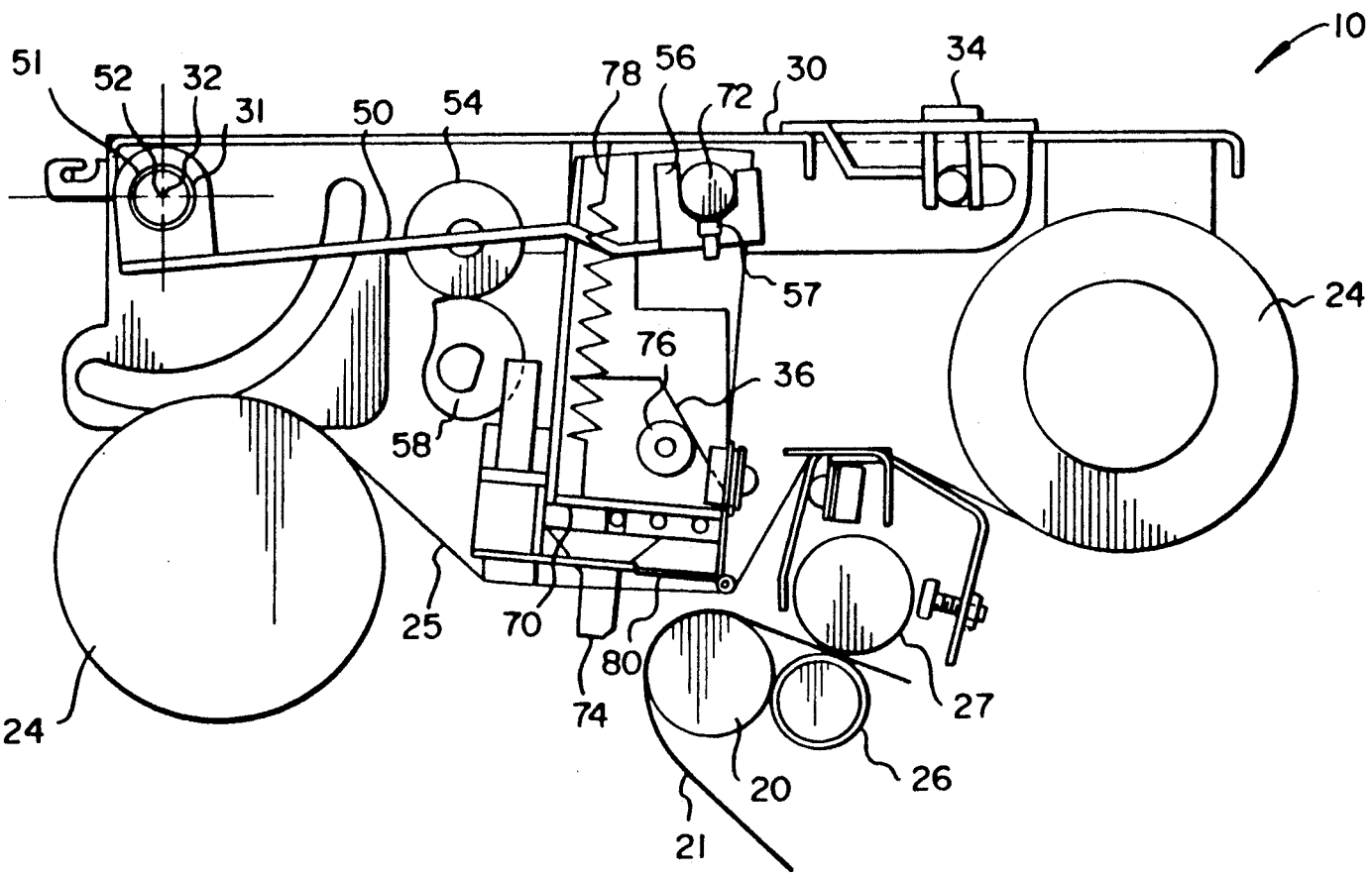
FIG. 5 shows a sectional view of FIG. 2's print head assembly, head positioning mechanism and cover mechanism in an ejecting position.

Normal thermal printer operations include loading receiver medium, printing information upon the receiver medium and ejecting the finished print. FIGS. 3 through 5 describe each of these operations.

Printer operation begins with the loading phase. The loading phase moves the print head assembly 70 to a loading position, advances a sheet of a receiver medium 21 to a printing location, and positions the print head assembly 70 in preparation for the printing operation.

FIG. 3 shows the cover mechanism 30 and its attached components in relation to the platen assembly 20 and a portion of a receiver medium transport mechanism 26 when the printer is in the loading receiver medium phase of operation. In this phase of printer operation the print head assembly 70 and head positioning arm 50 begin in their ejecting positions, which are at the highest point of travel of the head positioning arm 50 range of motion.

A first cam 58 is driven to a loading position which is between the ejecting and the printing positions. A first cam follower 54 attached to the head positioning arm 50 maintains contact with the first cam 58, and the head positioning arm 50 rotates about its mounting axis 52 to a loading position. The first cam follower 54 is, in this embodiment, a rotating device such as a bearing in order to reduce friction. However other follower types are possible, such as a pin formed of metal or other materials, such as Teflon.

A pin receiving recess 56 located on the head positioning arm 50 constrains a first pin 72 of the print head assembly 70 to movement in one axis, which in the case of this embodiment is the vertical axis. In the loading position, the first pin 72 contacts a side of the pin receiving recess 56 and an adjustment screw 57. The adjustment screw 57 sets the point at which the head positioning arm 50 contacts the first pin 72 as the arm 50 moves from the print position to other positions. Further, adjustment screw 57 can also modify the point in the head positioning arm's 50 motion at which a second cam follower 76 contacts a second cam surface 36.

A spring 78, which presses the print head assembly 70 in the direction of the platen assembly 20, assures the first pin 72 contacts the sides of the pin receiving recess 56 and the adjustment screw 57, and that the second cam follower 76 is pressed against the second cam surface 36. As the head positioning arm 50 moves to a loading position, the print head assembly 70 moves to its loading position. The second cam follower 76 allows the print head assembly 70 to tilt toward the platen assembly 20, until guides 74 contact the platen assembly 20. When the print head assembly 70 reaches its loading position, the second cam follower 76 is shown in contact with the first cam surface 36, and the print head 80 is spaced a distance away from the platen assembly 20. It will be understood, however, that the operation would not change if the second cam follower 76 was not in contact with the first cam surface 36.

A sheet of receiver medium 21 moves forward into a receiver guide 28 where it follows a curved path toward a gap between the print head assembly 70 and the platen assembly 20. As the receiver medium 21 moves into this gap, it contacts a dye donor medium 25 and is guided toward a receiver medium transport mechanism 26, 27. When the receiver medium 21 is properly positioned, the receiver medium 21 is captured between a transport mechanism 26 and a pinch roller 27. While this embodiment describes receiver medium in sheet form, receiver medium supplied in roll form could also be utilized.

Once the receiver medium 21 is firmly held by the receiver medium transport mechanism 26 and 27, the first cam 58 is driven to a printing position. A first cam follower 54 remains in contact with the first cam 58 and the head positioning arm 50 rotates about its mounting axis 52 until it reaches a printing position. As this process occurs, the print head assembly 70 moves toward the platen assembly 20, pressing the dye donor medium 25 and the dye receiver medium 21 against the platen assembly 20 to form a sandwich for thermal printing. As the print head assembly 70 moves into its printing position, the guide 74 remains in contact with the platen assembly 20 and a second cam follower 76 moves away from a first cam surface 36.

As the print head assembly 70 moves from the ejecting position to the loading position and on to the printing position, the guide 74 first contacts the platen assembly 20 to insure the print head assembly 70 is aligned to the rotation axis of the platen assembly 20. As the print head assembly 70 continues to move further, the print head 80 is pressed against the platen assembly 20 in a roughly orthogonal direction to insure alignment and proper fit of the head to the platen in an axis orthogonal to a plane connecting the rotation axis of the platen assembly 20 and the contact point of the guide 74 to the platen assembly 20. This insures that the print head 80 is nearly parallel to the axis of rotation of the platen assembly 20.

When the loading phase of operation is completed, the printer 10 enters the printing phase of operation, during which the print head assembly 70 presses the dye donor medium 25 and the dye receiver medium 21 into the platen assembly 20 and prints information on the dye receiver medium 21.

FIG. 4 shows the cover mechanism 30 and its attached components in relation to the platen assembly 20 and a portion of the receiver medium transport mechanism 26 when the printer is in the printing phase of operation. At this point in the printer's operation the first cam 58 is at a printing position. The first cam surface follower 54 contacts the first cam 58 such that the head positioning arm 50 pivots about its mounting axis 52 to the lowest point of the arm's range of motion.

As shown in FIG. 4, the lowest position of the head positioning arm 50's range provides a gap between the adjustment screw 57 and first pin 72. Other embodiments are possible where a different gap or no gap exists between the adjustment screw 57 and the first pin 72. The needs of this invention are satisfied when no upward force is applied to the first pin 72 by the adjustment screw 57, at this point in the printer's operation.

The position of the head positioning arm 50 is such that the first pin 72 contacts a side of the pin receiving recess 56 but does not contact the adjustment screw 57. The print head assembly 70 is isolated from disturbances and distortions caused by movement in the cover mechanism 30 by two features of this component configuration—(1) the coaxial mounting axes 32 and 52 of the cover 30 and the head positioning arm 50 respectively, and (2) the concept that the first pin 72 does not contact the bottom of the pin receiving recess 56.

The print head assembly 70 has a guide member 74 attached to it which contacts the platen assembly 20. In this embodiment, the guide member 74 contacts both ends of the platen assembly 20 at bearing surfaces which rotate independently of the platen. Other component configurations are possible, such as the guides contacting the platen surface, or having no bearings on the platen assembly, or other configurations.

The print head 80 is attached to the print head assembly 70 such that it presses the dye donor medium 25 and the dye receiver medium 21 against the platen assembly 20 during the printing phase of operation. The contact point of the print head 80 with the platen assembly 20 is about 90 degrees from the contact point of the guide 74 to the platen assembly 20. The spring 78 is located between the cover mechanism 30 and the print head assembly 70 such that the guide 74 and the print head 80 are pressed against the platen assembly 20.

The print head assembly 70 further has a second cam follower 76 which does not contact the second cam surface 36 in the printing position. The second cam follower 76 is, in this embodiment, a bearing but could be a pin of metal or Teflon, or other devices.

When the printing phase of operation is completed, the printer 10 enters the ejecting phase of operation, during which the print head assembly is retracted from the platen assembly and the finished print is ejected from the printer.

FIG. 5 shows the cover mechanism 30 and its attached components in relation to the platen assembly 20 and a portion of the receiver medium transport mechanism 26 when the printer is ejecting the finished print. Following completion of the printing operation, the first cam 58 is driven to an ejecting position. The motion of the cam presses the first cam follower 54 which causes the head positioning arm 50 to pivot about its mounting axis 52, raising the arm 50 to the highest position in its range of motion. As the head positioning arm 50 moves, the first pin 72 of the print head assembly 70 contacts the adjustment screw 57 as well as the sides of the pin receiving recess 56, and the print head assembly 70 is lifted from contact with the platen assembly 20. As the print head assembly 70 moves, the second cam follower 76 contacts the second cam surface member 36 while the head positioning arm 50 is at an intermediate position between the lowest and highest position in its range of motion. Appropriately setting the adjustment screw 57 adjusts a loading gap between the print head 80 and the platen 20, and also adjusts the point of contact between the second cam follower 76 and the second cam surface 36. As the head positioning arm 50 continues to move to its highest position, the second cam surface 36 presses the second cam follower 76, forcing the print head assembly 70 to tilt as it lifts further away from the platen assembly 20. When the first cam 58 reaches an ejecting position, the head positioning arm 50 is at its highest position and the print head assembly 70 has lifted and tilted away from the platen assembly 20 to provide clearance and minimize friction for the efficient ejection of the completed print on the receiver medium 21.

When the print head assembly 70 is in the ejecting position, the receiver medium transport mechanism roller 26 which captures the receiver medium 21 between it and the pinch roller 27 drives the completed print out of the thermal printer 10.

When the ejecting phase of the printer operation is completed, a complete printing cycle is finished and the printer is ready to begin another printing operation.

Figure 6A:
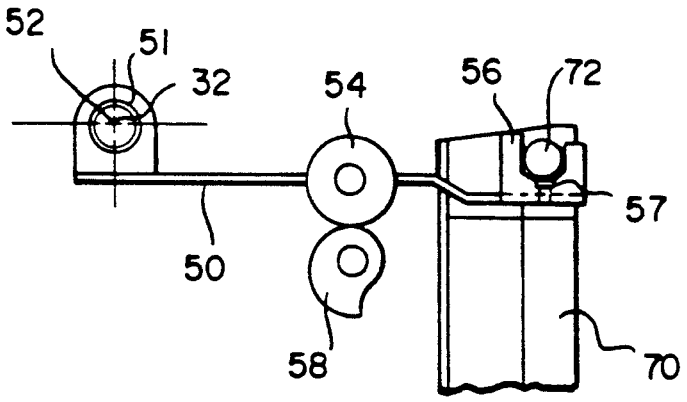
FIG. 6A shows the head positioning arm and print head assembly in a LOAD position, where a first pin is in contact with an adjustment screw.
Figure 6B:
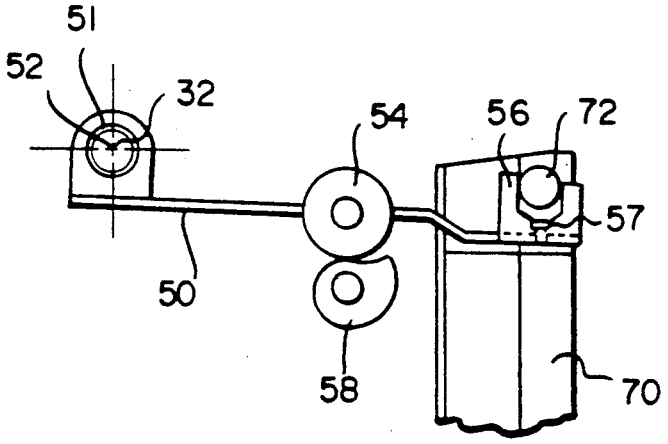
FIG. 6B shows the head positioning arm and print head assembly in a PRINT position, where a first pin does not touch the adjustment screw.
Figure 6C:
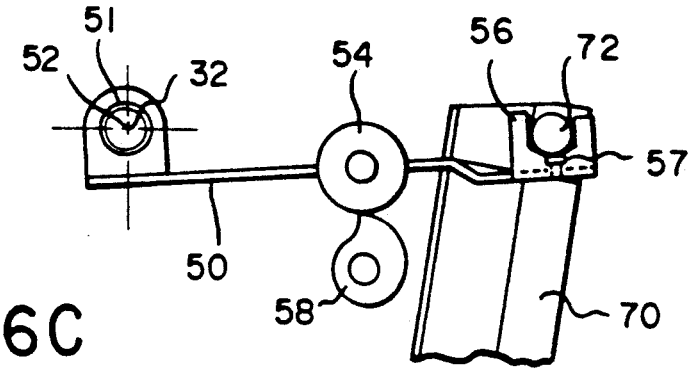
FIG. 6C shows the head positioning arm and print head assembly in an EJECT position, where a first pin is in contact with an adjustment screw.

FIGS. 6A–C show the pin receiving recess 56 and adjustment screw 57 of the head positioning arm 50 and the first pin 72 of the print head assembly 70 in the loading, printing and ejecting positions respectively.

In FIG. 6A the first cam 58 and head positioning arm 50 are in the loading position. The first pin 72 contacts the pin receiving recess 56 and the adjustment screw 57 where the height of screw 57 sets the point at which the head positioning arm 50 contacts the first pin 72 as the arm 50 moves from the print position to other positions. The adjustment screw 57 allows lower cost manufacturing processes for the head positioning arm 50 and pin receiving recess 56 while controlling where the arm 50 and first pin 72 contact.

FIG. 6B shows the first pin 72, the pin receiving recess 56 and the adjustment screw 57 in a printing position where the first pin 72 does not contact the adjustment screw 57, insuring the print head assembly 70 presses fully against the media 21, 25 not shown in this view for clarity of description (see FIG. 5), and the roller platen 20 not shown in this view. As previously stated, a gap is shown between the adjustment screw 57 and the first pin 72 in FIG. 6B, however, other embodiments are possible, including no gap, so long as no upward force is applied to the first pin 72 by the adjustment screw 57 at this point in the printer's operation.

FIG. 6C shows the first pin 72 in contact with the pin receiving recess 56 and the adjustment screw 57 in an ejecting position. The print head assembly 70 rotated about first pin 72 as the head positioning arm 50 moved to the eject position and the second cam follower 76

(not shown) pressed against the second cam surface 36 (not shown).

The embodiment of this invention describes a thermal printer with the print head assembly and dye donor supply spool attached to the cover mechanism, and the platen assembly and receiver medium supply contained in the main printer structure. It is equally feasible to reverse this configuration such that the cover mechanism includes the platen assembly and the receiver medium supply (as in U.S. Pat. No. 4,838,713) while the print head assembly and donor medium supply are attached to the main printer structure. Such an alternate configuration would have a platen positioning arm in place of a head positioning arm, and the platen assembly would be in the place of the print head assembly as described in the previous embodiment. Further, the print head assembly would be located in the position of the platen assembly in the previous embodiment. Also, the receiver medium supply and the dye donor supply spool would be interchanged in the alternate configuration.

ADVANTAGES

1. A common mounting axis for both a cover mechanism and a head positioning arm isolates a print head from disturbances or distortions caused by a force being applied to the cover mechanism, such as the operator leaning on the cover, which result in inferior print quality.

2. When printing, the print head floats in the axis perpendicular to a roller platen, further isolating it from mechanical disturbances which can decrease print quality.

3. The design of a first pin on a print head assembly is such that it does not contact the bottom of a pin receiving recess on the head positioning arm. This helps isolate the print head assembly from vibrations and disturbances caused by movements in the cover mechanism or other parts of the printer structure.

4. When loading, the print head assembly is removed some distance from the roller platen, reducing pressure on the donor media, receiver media and the roller platen, permitting the receiver media to be guided along the receiver media transport path with reduced friction levels.

5. When ejecting, the print head assembly is moved a larger distance from and to one side of the roller platen to provide a large area for media movement during the ejection process, permitting increased speed of operation.

6. A guide means of the print head assembly insures proper alignment of the print head to the roller platen.

7. A resilient spring member urges the print head assembly against the roller platen, insuring proper seating of the guiding means against the roller platen.

8. The resilient spring member also urges a first cam follower into a first cam surface to insure the print head assembly is properly positioned in all operations.

9. The fact that a guide contacts the platen assembly first, followed by contact with a print head, ensures accurate alignment of the print head to the platen assembly.

10. An adjustment screw sets the point of contact between the head positioning arm and the first pin as the arm moves from the printing position to other positions, allowing lower cost components for the head positioning arm.

The invention has been described in detail with particular reference to certain preferred embodiments thereof, but it will be understood that variations and modifications can be effected within the spirit and scope of the invention.

I claim:

1. In a thermal printer which has a roller platen, a dye receiver medium held against the roller platen and a print head which presses a dye donor medium against the receiver and roller platen in a sandwich for dye transfer, the improvement comprising:

a) a cover mechanism rotatably mounted about a first axis, including latching means secured to the cover mechanism for holding the cover mechanism in a closed position during operation and permitting the cover mechanism to be opened at other times;

b) a head positioning arm rotatably mounted about a second axis such that the head positioning arm is movable between a printing position, a loading position and an ejecting position;

c) a print head assembly which includes a print head, said assembly being responsive to said head positioning arm to move said print head to corresponding loading, printing and ejecting positions; and (d) the first and second axes being substantially coaxial to thereby reduce undesirable movement of the print head.

2. The thermal printer of claim 1 wherein said cover mechanism is rotatably mounted on a first shaft and said head positioning arm is rotatably mounted on a second shaft coaxial with said first shaft.

3. In a thermal printer which has a roller platen, a dye receiver medium held against the roller platen and a print head which presses a dye donor medium against the receiver and roller platen in a sandwich for dye transfer, the improvement comprising:

a) a cover mechanism rotatably mounted about a first axis, including latching means secured to the cover mechanism for holding the cover mechanism in a closed position during operation and permitting the cover mechanism to be opened at other times;

b) a head positioning arm rotatably mounted about a second axis such that the head positioning arm is movable between a printing position, a loading position and an ejecting position, and said head positioning arm further having a first cam follower and a pin receiving recess which permits movement along an arc;

c) a print head assembly which is responsive to said head positioning arm for movement of said print head assembly to corresponding loading, printing and ejecting positions, and said print head assembly further including a first pin for engaging said pin receiving recess, guide means which aligns said print head assembly to said roller platen, and a second cam follower;

d) a first cam which can bear against said first cam follower such that said head positioning arm moves to a corresponding printing, loading or ejecting positions as said first cam rotates;

e) a member fixedly secured to said cover mechanism which defines a second cam surface, and resilient means urging said print head assembly against said roller platen or said second cam surface; and (f) the first and second axes being substantially coaxial to thereby reduce undesirable movement of the print head.

4. The thermal printer of claim 3 wherein said cover mechanism is rotatably mounted on a first shaft and said head positioning arm is rotatably mounted on a second shaft coaxial with said first shaft.

5. The thermal printer of claim 3 whereby as said head positioning arm moves along an arc from a printing position to other positions, said second cam follower bears against said second cam surface for a portion of the motion of said head positioning arm's movement, such that the second cam follower does not contact the second cam surface in the printing position and contacts the second cam surface in the ejecting position 6. The thermal printer of claim 3 wherein as said head positioning arm moves from the printing position to other positions said first cam rotates, pressing against said first cam follower such that said pin receiving recess of said head positioning arm moves against said first pin, lifting said print head assembly so said print head does not press said dye donor medium or said dye receiver medium into said platen, and as said first cam continues to rotate and further move said pin receiving recess against said first pin, said second cam follower pushes against said second cam surface to move said print head assembly away and offset from said roller platen.

7. The thermal printer of claim 3 whereby as said head positioning arm moves from an ejecting position to a loading position, said first cam rotates to lower said pin receiving recess of said head positioning arm and in turn lower said print head assembly so that said assembly tilts until said guide means contact said platen.

8. The thermal printer of claim 3 wherein an adjustment screw in close proximity to said pin receiving recess adjusts where said head positioning arm contacts said first pin as said arm moves from the print position to other positions.

* * * * *